US009954301B2

(12) United States Patent
Luthy et al.

(10) Patent No.: US 9,954,301 B2
(45) Date of Patent: Apr. 24, 2018

(54) CONNECTOR WITH TPA

(71) Applicant: Molex, LLC, Lisle, IL (US)

(72) Inventors: John Luthy, Naperville, IL (US); Steven Sousek, Lincoln, NE (US); Timothy R. Gregori, Lockport, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/204,546

(22) Filed: Jul. 7, 2016

(65) Prior Publication Data

US 2016/0322734 A1 Nov. 3, 2016

Related U.S. Application Data

(63) Continuation of application No. 14/779,169, filed as application No. PCT/US2014/032345 on Mar. 31, 2014, now Pat. No. 9,490,568.

(60) Provisional application No. 61/806,593, filed on Mar. 29, 2013.

(51) Int. Cl.
*H01R 13/42* (2006.01)
*H01R 13/436* (2006.01)

(52) U.S. Cl.
CPC ..... *H01R 13/4364* (2013.01); *H01R 13/4361* (2013.01)

(58) Field of Classification Search
CPC ..... H01R 13/4364; H01R 13/4361
USPC ..... 439/751, 596, 752, 752.5, 467
See application file for complete search history.

(56) References Cited

U.S. PATENT DOCUMENTS

| | | | | | |
|---|---|---|---|---|---|
| 4,017,141 | A | | 4/1977 | Bury et al. | |
| 4,679,874 | A | | 7/1987 | Saijo et al. | |
| 4,946,398 | A | | 8/1990 | Takenouchi et al. | |
| 4,979,913 | A | * | 12/1990 | Aiello | H01R 13/422 439/596 |
| 5,354,218 | A | * | 10/1994 | Fry | H01R 13/422 439/595 |
| 5,407,363 | A | * | 4/1995 | Polgar | H01R 13/74 248/222.52 |

(Continued)

FOREIGN PATENT DOCUMENTS

| | | | |
|---|---|---|---|
| GB | 2177855 | A | 1/1987 |
| JP | 03-17413 | U | 2/1991 |

(Continued)

*Primary Examiner* — Abdullah Riyami
*Assistant Examiner* — Nelson R Burgos-Guntin
(74) *Attorney, Agent, or Firm* — James A. O'Malley

(57) ABSTRACT

A connector has a housing and a TPA member. The housing has a base which includes a first and second sides and a top surface that extends between the sides. The base further includes a channel. The TPA member is operatively associated with the housing and has at least one hinge which extends from the top surface. The at least one hinge has top and bottom portions. The bottom portion is provided proximate to the base and the top portion has a portion thereof cutout to provide a weakened portion of the at least one hinge. The TPA member further includes a rearwardly extending L-shaped feature. Upon a force being applied to the TPA member, the at least one hinge is configured to first rotate about the weakened portion and, thereafter, is configured to rotate about the bottom portion, thereby allowing the L-shaped feature to be inserted into the channel.

24 Claims, 14 Drawing Sheets

(56) References Cited

U.S. PATENT DOCUMENTS 5,435,758 A * 7/1995 Sasai ..... H01R 13/4368 439/752
5,522,740 A 6/1996 Plocek et al.
5,595,509 A * 1/1997 Fry ..... H01R 13/4362 439/595
5,620,346 A 4/1997 Okumura
5,647,775 A * 7/1997 Polgar ..... H01R 13/4361 439/752
5,697,819 A * 12/1997 Hatagishi ..... H01R 13/501 439/752
5,713,756 A * 2/1998 Abe ..... H01R 13/501 439/404
5,779,506 A * 7/1998 Okabe ..... H01R 13/4361 439/752
5,800,216 A 9/1998 Okada
5,803,765 A * 9/1998 Peloza ..... H01R 12/7029 439/567
5,902,155 A * 5/1999 Polgar ..... H01R 13/518 439/353
6,024,605 A * 2/2000 Beck, Jr. ..... H01R 13/424 439/595
6,027,374 A * 2/2000 Nagai ..... H01R 13/4361 439/596
6,106,340 A * 8/2000 Myer ..... H01R 13/4367 439/595
6,116,954 A * 9/2000 Ries ..... H01R 13/506 439/423
6,183,313 B1 2/2001 Kashiyama
6,250,972 B1 * 6/2001 Shinchi ..... H01R 13/504 439/465
6,273,755 B1 * 8/2001 Yamamoto ..... H01R 13/4367 439/596
6,299,471 B1 * 10/2001 Hatagishi ..... H01R 4/2425 439/397
6,340,321 B2 * 1/2002 Sawayanagi ..... H01R 13/4364 439/877
6,416,700 B1 * 7/2002 Hatagishi ..... B29C 45/0017 264/242
6,443,767 B1 * 9/2002 Nagai ..... H01R 13/501 439/596
6,482,026 B2 * 11/2002 Morita ..... H01R 43/01 439/397
6,482,035 B2 * 11/2002 Okabe ..... H01R 4/2433 439/596
6,561,837 B1 * 5/2003 Ishida ..... H01R 4/2466 439/397
6,726,497 B2 4/2004 Nogawa et al.
6,881,102 B2 * 4/2005 Correll ..... H01R 13/428 439/752
6,887,104 B2 * 5/2005 Lee ..... H01R 43/0249 439/374
6,918,798 B2 * 7/2005 Patel ..... H01R 13/114 439/851
7,004,791 B2 * 2/2006 Mumper ..... H01R 43/18 439/595
7,004,796 B2 * 2/2006 Fukuda ..... H01R 43/20 439/752
7,540,749 B1 * 6/2009 Hall ..... H01R 13/516 439/135
8,043,104 B2 10/2011 Taketomi
8,550,860 B2 10/2013 Dick et al.
9,070,999 B2 * 6/2015 Endo ..... H01R 13/506
9,083,108 B2 * 7/2015 Adachi ..... H01R 13/521
9,236,679 B2 * 1/2016 Beckstedt ..... H01R 4/36
2003/0139094 A1 * 7/2003 Venditti ..... H01R 13/506 439/596
2004/0235365 A1 * 11/2004 Fujita ..... H01R 13/516 439/752
2010/0041280 A1 * 2/2010 Morello ..... H01R 13/422 439/752
2016/0013575 A1 * 1/2016 Campbell ..... H01R 13/4362 439/752
2016/0056563 A1 * 2/2016 Luthy ..... H01R 13/4364 439/751

FOREIGN PATENT DOCUMENTS

JP 07-245141 A 9/1995
JP 10-50383 A 2/1998
JP 10-214650 A 8/1998
JP 2006-164843 A 6/2006

* cited by examiner

CONNECTOR WITH TPA

RELATED APPLICATIONS

This application is a continuation-in-part of U.S. patent application Ser. No. 14/779,169, filed Sep. 22, 2015, which issued as U.S. Pat. No. 9,490,568 on Nov. 8, 2016, which is a national phase application of International Application No. PCT/US14/32345, filed Mar. 31, 2014, which, in turn, claims priority to U.S. Provisional Patent Application Ser. No. 61/806,593, filed Mar. 29, 2013, wherein each of the foregoing applications are incorporated herein by reference in their entireties.

FIELD OF THE INVENTION

The present disclosure relates to field of connectors, more specifically to the field of connectors suitable for use on the end of a wire.

DESCRIPTION OF RELATED ART

Connectors with terminal position assurance (TPA) features are known. In general, a TPA feature helps ensure that a terminal is retained in a housing. Often such TPA features are provided by separate components that must be mated to a housing after the terminals are positioned in the housing. While hinged TPAs have also been provided, existing designs don't provide the desired set of features that ensure terminals are appropriately retained and positioned with the desired levels of reliability and ease of use. Thus certain individuals would appreciate further improvements in a connector with a TPA member.

BRIEF SUMMARY

A connector is provided that includes a housing with one more discrete insulated channels. Each channel is configured to receive a terminal in a manner that prevents over insertion of the terminal into the channel. A terminal position assurance (TPA) member is hinged to the housing. The TPA member is configured so that it can be translated from an open position to a locked positioned and in the locked position the TPA member is configured to ensure the terminals are appropriately positioned and retained in their respective channels.

BRIEF DESCRIPTION OF THE DRAWINGS

The present disclosure is illustrated by way of example and not limited in the accompanying figures in which like reference numerals indicate similar elements and in which:

FIGS. 11 and 12 illustrate elevated side views, FIGS. 13-15 illustrate cross-sectional side views, and FIGS. 16 and 17 illustrate elevated front views.

DETAILED DESCRIPTION

Figure 1A:
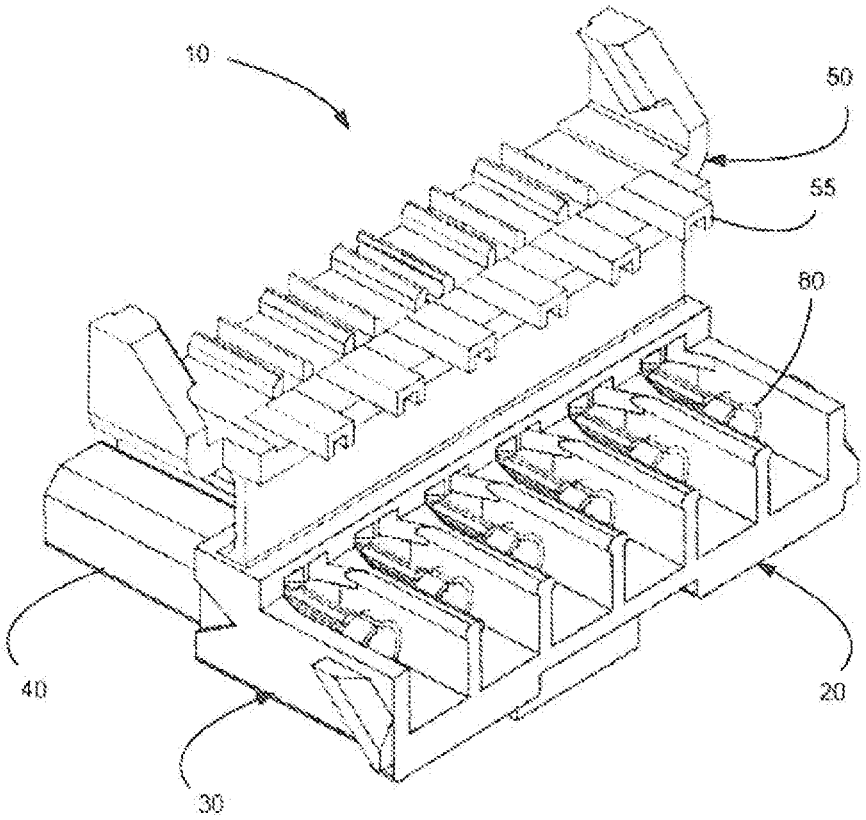
FIG. 1A illustrates a perspective view a first embodiment of a connector with a TPA member that is hinged to a housing with the TPA in an open position.
Figure 1B:
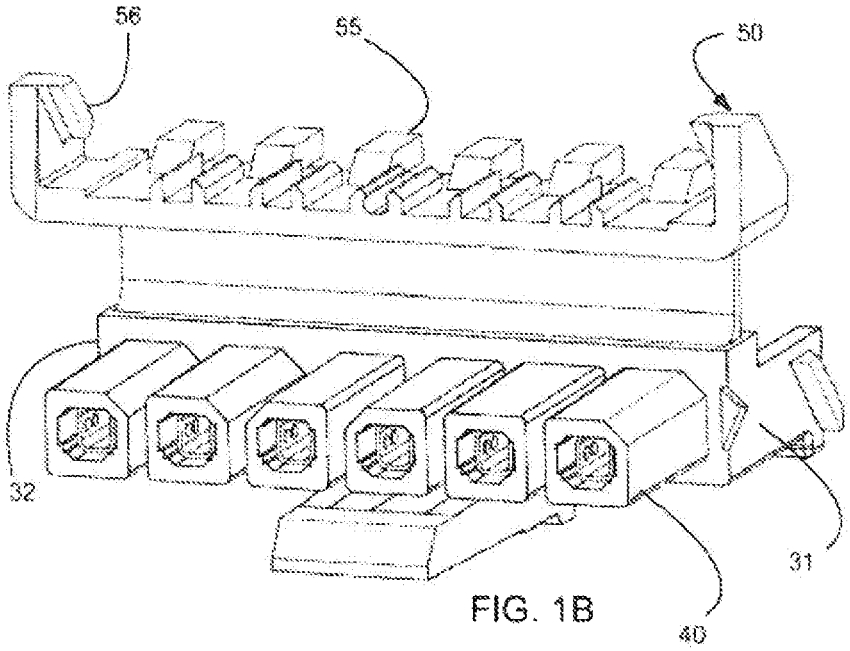
FIG. 1B illustrates another perspective view of the first embodiment depicted in FIG. 1A.
Figure 2:
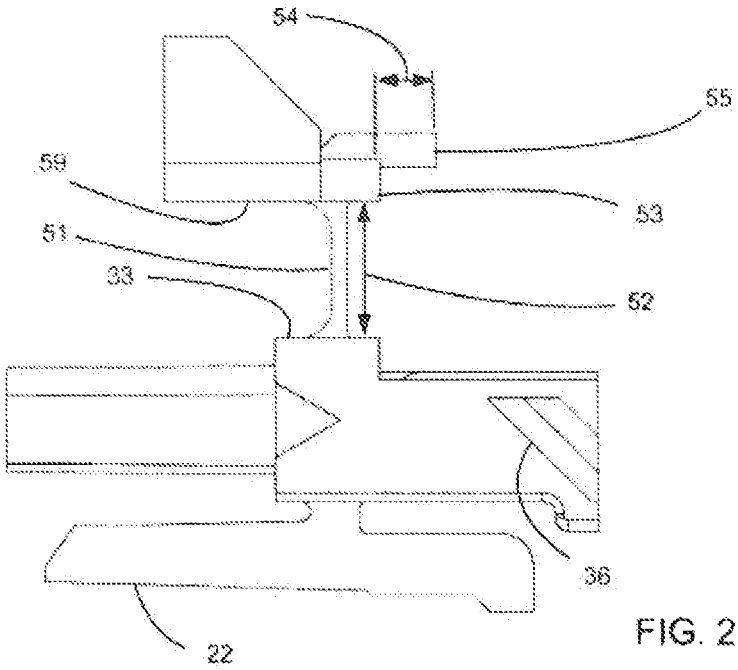
FIG. 2 illustrates an elevated side view of the first embodiment depicted in FIG. 1A.
Figure 3:
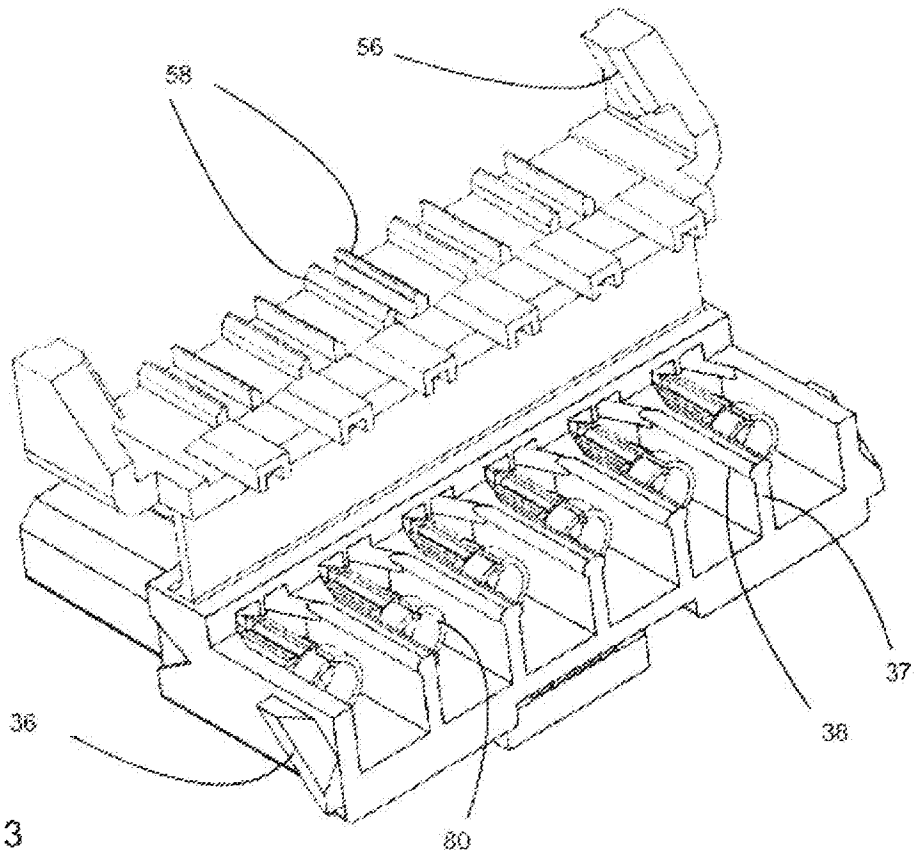
FIG. 3 illustrates an enlarged view of the first embodiment depicted in FIG. 1A.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

FIGS. 1A-10 illustrate features of a first embodiment of a connector with a terminal position assurance (TPA) member hinged to the housing. As can be appreciated, the benefit of connecting the TPA directly to the housing is that a single molding operation can be used to provide the housing and the TPA member, thus potentially reducing costs. Thus depicted design can be a one-piece molded design. However, one issue with such designs is that it is more challenging to provide a hinged TPA member that doesn't just retain but also helps position terminals. Certain TPA members have attempted to provided such a feature but because of the complexity of the TPA member, those TPA member were either not attached to the housing (making the use of the TPA member more challenging as care was needed to ensure it was available when need) or they attached to the housing with just two hinges that were small to help ensure flexibility.

Applicants have determined that using a hinge that extends substantially a width of the base provides increased control over the position of the TPA member when it is translated into a locking position, helping to prevent misalignment during the translation of the TPA member. This in turn helps ensure the TPA member is properly positioned and has properly engaged each of the terminals. Such a design can also allow for substantial translation of the TPA member (for example, the TPA member can be rotated approximately 180 degrees).

Thus, as depicted a connector 10 includes a housing 20 with a base 30 that includes one or more channels 25. An optional and integral latch 22 can be provided as depicted. Each channel 25 extends to a nose 40 that extends from the base 30. A terminal 80 can be positioned in the channel 25. The nose 40 can be configured so that there is a gap (e.g., an air channel) between two adjacent noses 40 and the nose includes an interior surface 42 that defines a portion of the channel 25. The channel 25 has a first width 28*a* in the nose 40 and a second width 28*b* in the base 30. The base 30 has a first side 31, a second side 32 and a top surface 33 and includes angled retention flange 36 with a sloped surface

36*a* on both the first and second sides 31, 32. The base includes a wall 37 with an enlarged end 38.

Figure 4:
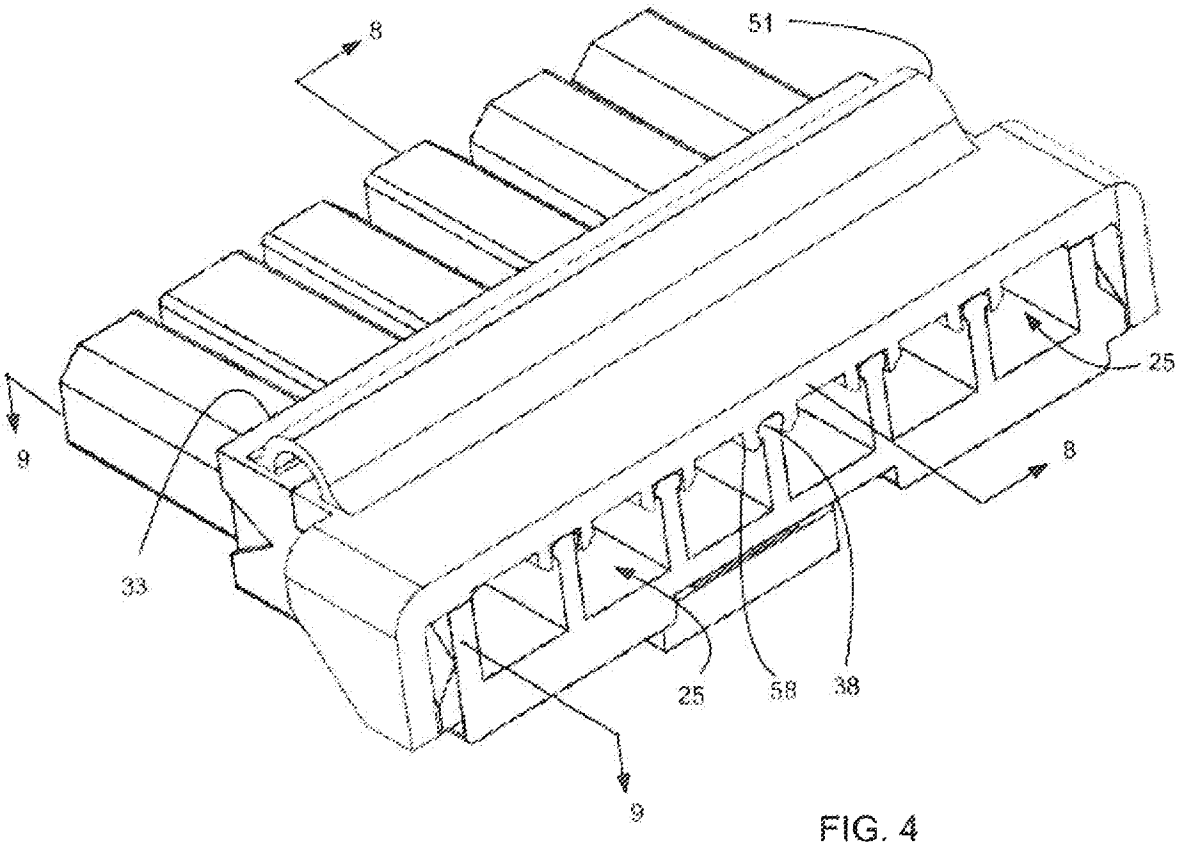
FIG. 4 illustrates a perspective view of the first embodiment of a connector with a hinged TPA with the TPA in a closed position.
Figure 5:
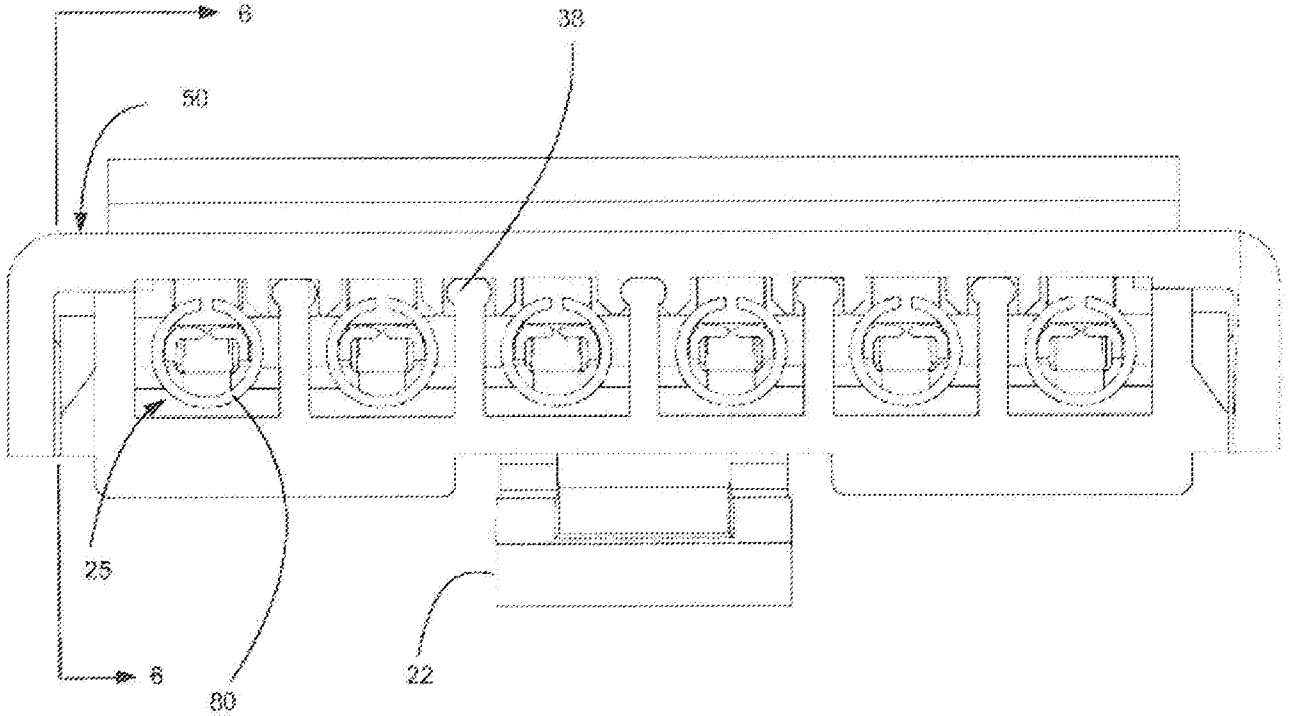
FIG. 5 illustrates an elevated front view of the first embodiment depicted in FIG. 4.
Figure 6:
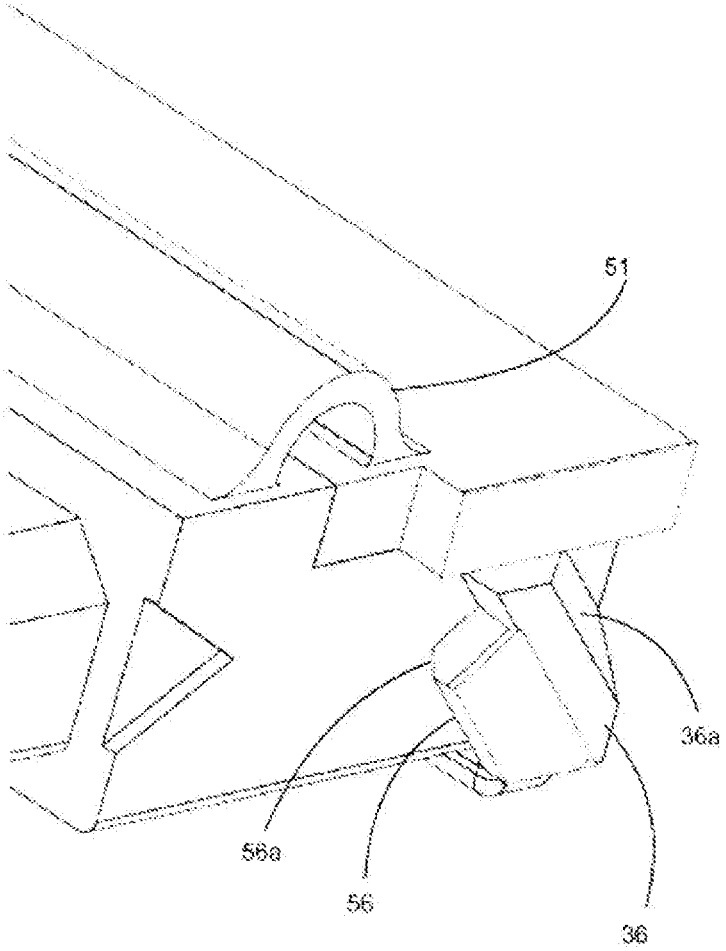
FIG. 6 illustrates a perspective view of a cross-section taken along line 6-6 in FIG. 4.
Figure 7A:
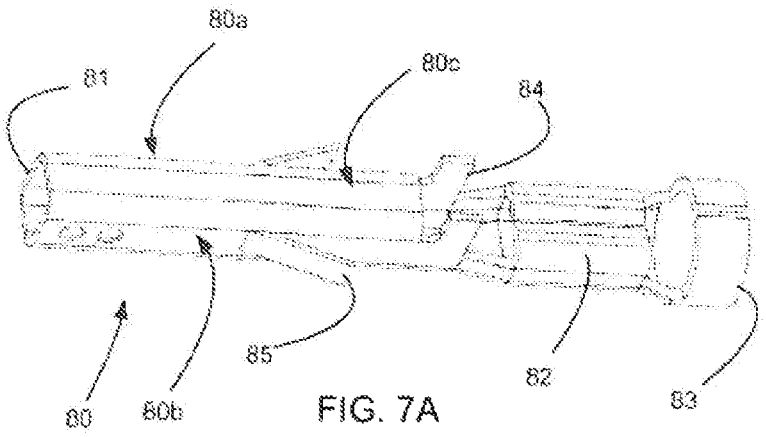
FIG. 7A illustrates a perspective view of an embodiment of a terminal.
Figure 7B:
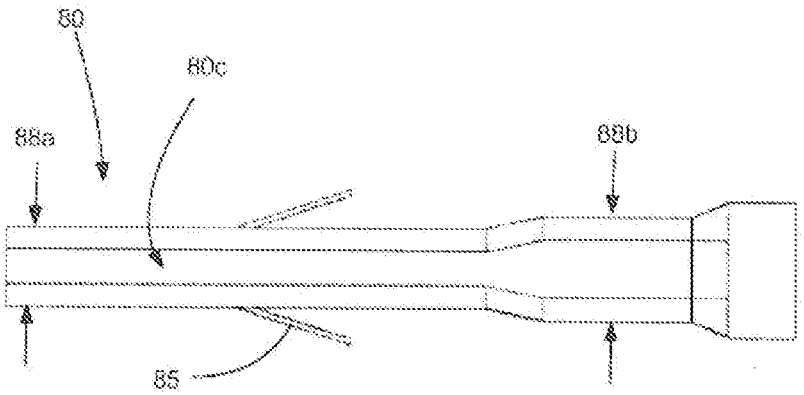
FIG. 7B illustrates a bottom view of the embodiment depicted in FIG. 7A.

A terminal position assurance (TPA) member 50 is supported by the base 30 and is connected to a top surface 33 of the base 30 via a hinge 51 that extends from a first side 31 of the base to a second side 32 of the base. The hinge 51 extends a distance 52 from the top surface 33 and provides sufficient space for the TPA member 50 to rotate more than 90 degrees, preferably about 180 degrees into a secured position. The TPA member 50 has a main wall 59 and includes a rear edge 53 that is configured to press against the base 30 and a pushing flange 55 extends from the main wall past the rear edge 53 a distance 54, the distance 54 being less than the distance 52. The pushing flange 55 can be u-shaped to provide additional support and to help securely hold a terminal in position. The TPA member 50 also include locking tab 56 with angled surface 56*a* and when the TPA member 50 is translated to the secured position the locking tab 56 engages angled retention flange 36 and the sloped surface 36*a* and the angled surface 56*a* aid in allowing the TPA member 50 to more easily snap into place. The TPA member 50 includes fingers 58 that are configured to engage enlarged end 38 when the TPA 50 is positioned in the secured position (as depicted in FIG. 4). It should be noted that the fingers 58 (which are provided in pairs) can be curved to more securely engage the enlarged ends 38 and while it has been determined to be beneficial in providing a more robust connector, such curvature is not required or may be used intermittently such that just one or some other number of fingers 58 securely engage the enlarged ends 38 (e.g., the fingers 58 can but do not need to snap over the enlarged ends 38).

As can be appreciated, once the TPA member 50 is in the secured position the hinge 51 is curved. As noted above, the use of a wider hinge 51 was found to provide more of a benefit then expected as it helps provide a more controlled translation of the TPA member 50

The terminal 80 includes a first side 80*a*, a second side 80*b*, a top side 80*c* and a bottom side 80*d* and has a contact end 81, a crimp 82 and an insulator arm 83 to help provide strain relief. It should be noted that the contact end 81 has a contact width 88*a* that is less than a crimp width 88*b* of crimp 82. In a typical configuration, the crimp 82 will securely engage a conductor and the insulator arm 83 will engage the insulation around the conductor. A projection 84 extends above the top side 80*c* and wings 85 are provided on opposing first and second sides 80*a*, 80*b*. It should be noted that while two projections 84 and two wings 85 are disclosed, the use of one of each could be used. The benefit of using both is that there is a more even distribution of force and improved retention of the terminal 80 in the housing 20.

Figure 8:
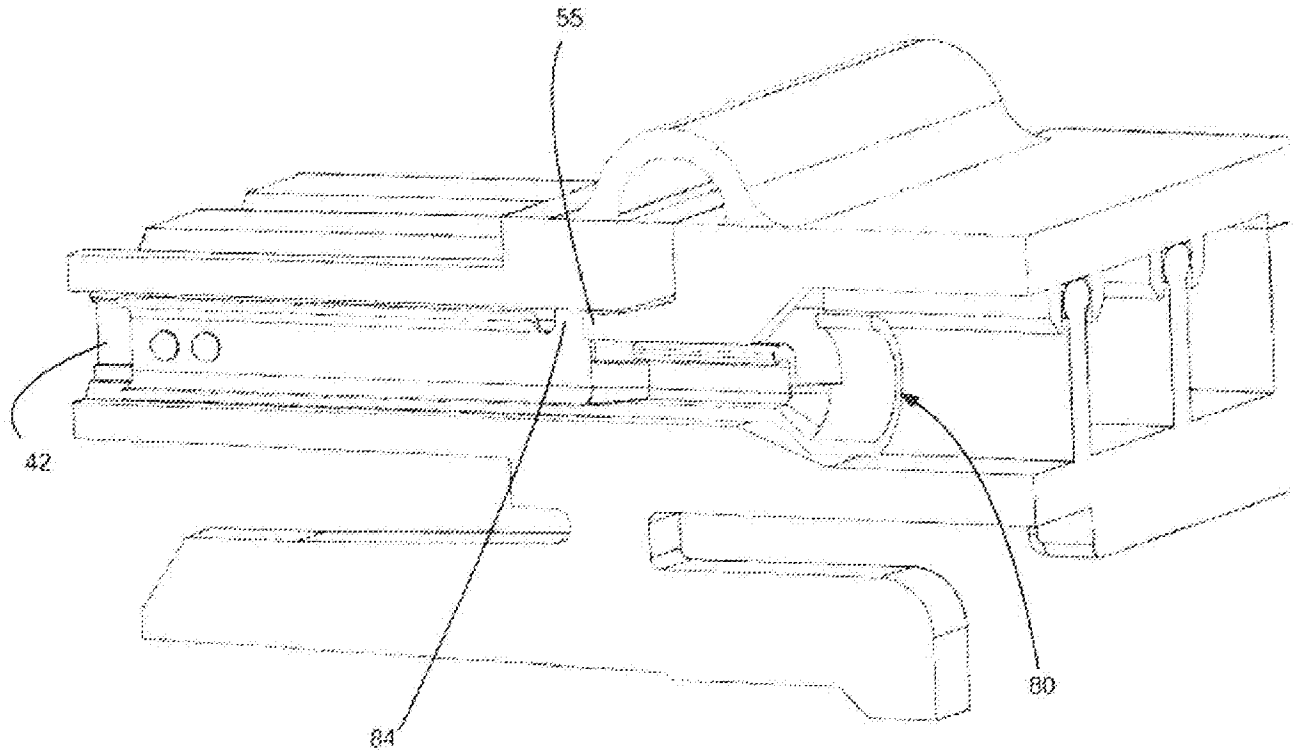
FIG. 8 illustrates a perspective view of a cross-section taken along line 8-8 in FIG. 4.
Figure 9:
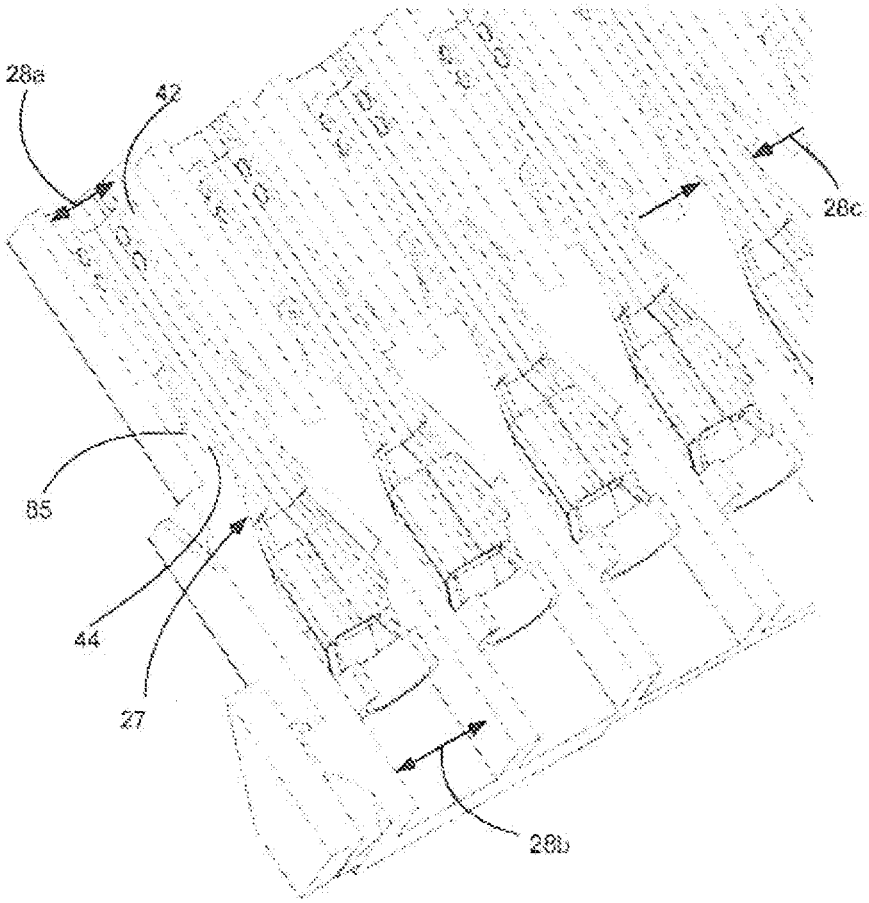
FIG. 9 illustrates a perspective view of a cross-section taken along line 9-9 in FIG. 4.

In operation, as can be appreciated from FIG. 8, the pushing flange 55 engages a projection 84 on the terminal 80 and helps position and secure the terminal 80 in the desired position in the channel 25. To provide for improved assembly process, a shoulder 44 in the interior surface 42 is provided and is configured to engage the wings 85. FIG. 9 illustrates the wings 85 overlapping the interior surface 42 but in practice, the wings 85 will just press against the interior surface 42 and will engage the shoulder 44 if the terminal 80 is attempted to be removed after the terminal is inserted into the channel 25. As can be appreciated, this helps ensure the terminal 80 doesn't accidentally fall out before the TPA member 50 is translated into the secure position. To help direct the terminal 80 into the desired orientation, a tapered portion 27 can be provided. The tapered portion 27, which necks down to a third width 28*c* that is less than the first width 28*a*, helps prevent the terminal 80 from being inserted sideways into the channel 25.

Figure 10:
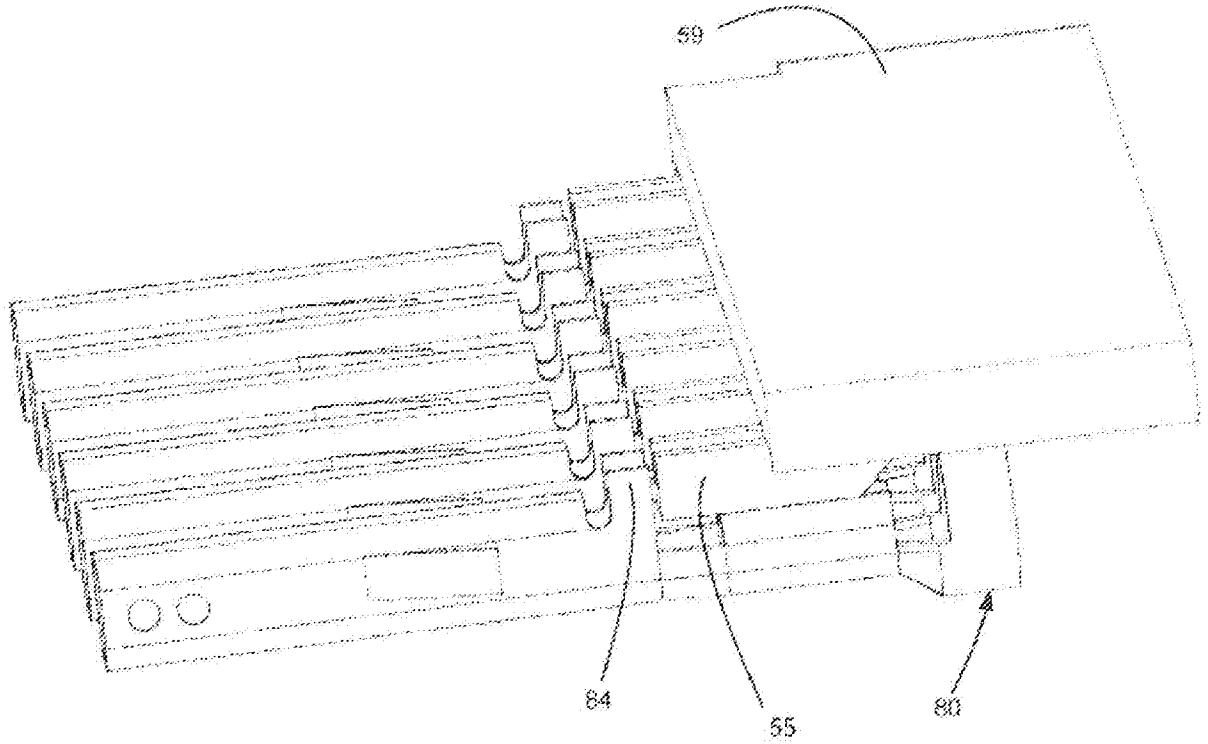
FIG. 10 illustrates a perspective view of a simplified embodiment with a terminal and a portion of a housing.

As can be appreciated from FIG. 10, the u-shape pushing flange 55 engages two projections 84 so as to provide a secure retention of the terminals 80. As noted above, this provides for additional reliability. Thus, the depicted connector provides for improved manufacturing due to offering a one-piece construction while providing a TPA that both helps position and also helps retain terminals in the connector.

FIGS. 11-17 illustrate features of a second embodiment of a connector 110 with a terminal position assurance (TPA) member 150 hinged to the housing 120. The connector 110 is preferably identical to the connector 10 of the first embodiment in all instances, except with regard to the configuration/operation of the hinge 51 and, therefore, for brevity purposes, further discussion regarding the structure of the connector 110 will be directed to the configuration of a hinge 151 and the operation of the connector 110 in connection with the hinge 151.

Figure 11:
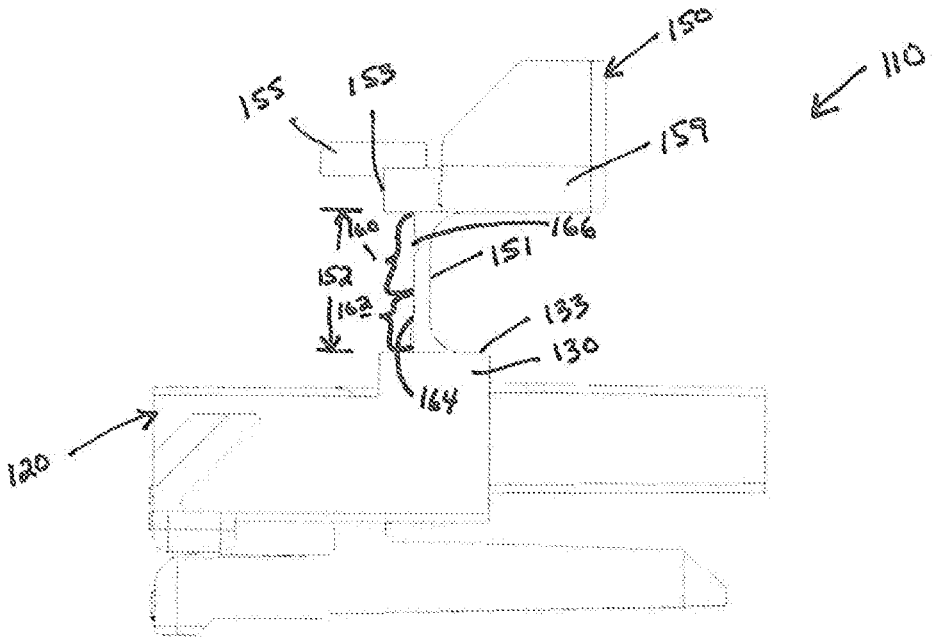
FIGS. 11-17 illustrate side views of a second embodiment of a connector where a hinged TPA member is moved from an open position to a closed position, where

As best illustrated in FIG. 11, the hinge 151 connects the TPA member 150 to a top surface 133 of the base 130. The hinge 151 extends a distance 152 between the TPA member 150 and the top surface 133 of the base 130. The hinge 151 has a top portion 160 and a bottom portion 162, where the top portion 160 generally comprises half of the distance 152 and the bottom portion 162 also generally comprises half of the distance 152. A rear side 164 of the top portion 160 of the hinge 151 is generally planar, but has a cutout portion 166. As the cutout portion 166 is provided in the top portion 160, the cutout portion 166 is provided more proximate to the TPA member 150 than to the top surface 133 of the base 130. As illustrated in FIG. 11, the cutout portion 166 is preferably crescent-shaped, but it is to be understood that the cut-out portion 166 could have other configurations.

Figure 12:
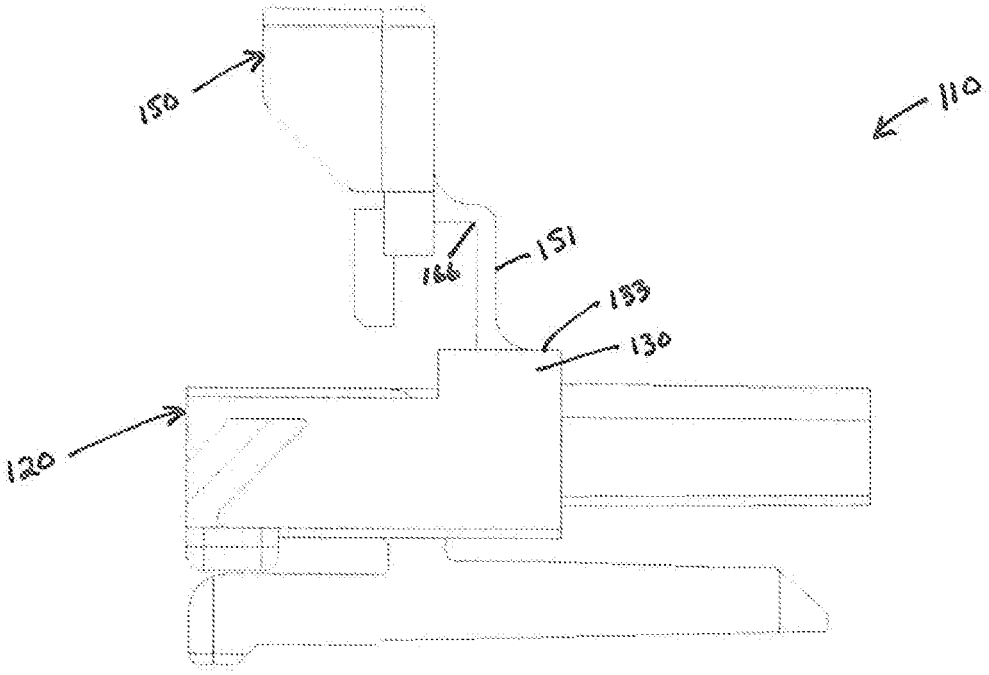

In operation, the provision of the cutout portion 166 in the top portion 160 of the hinge 151 provides benefits when the TPA member 150 is to be secured to the housing 120. The top portion 160 of the hinge 151 with the cutout portion 166 allows for the motion of the TPA member 150 to be controlled during actuation. The hinge 151 is the weakest where the cutout portion 166 is provided, such that when force is applied to the TPA member 150, the TPA member 150 is first forced to rotate around the axis of the cutout portion 166, as best illustrated in FIG. 12. Such rotation about the axis of the cutout portion 166 puts the TPA member 150 in the best position for the remainder of the actuating motion.

Figure 13:
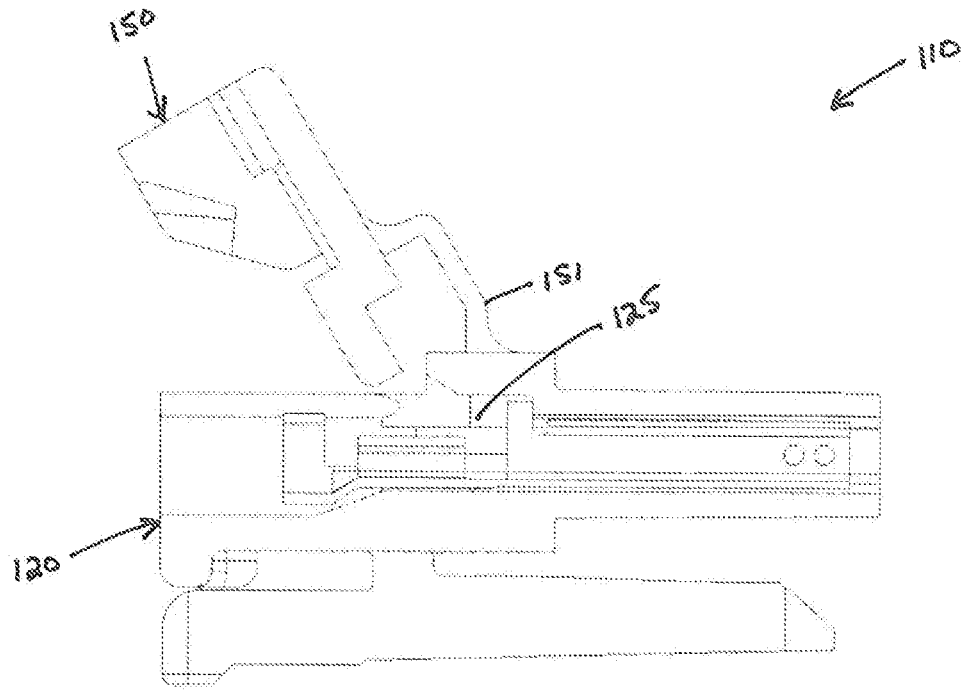

After the top portion 160 of the hinge 151 is rotated the approximately ninety (90) degrees, the continued actuation force causes the bottom portion 162 of the hinge 151, proximate to the housing 120, to rotate approximately ninety (90) degrees, as illustrated in FIG. 13.

Figure 14:
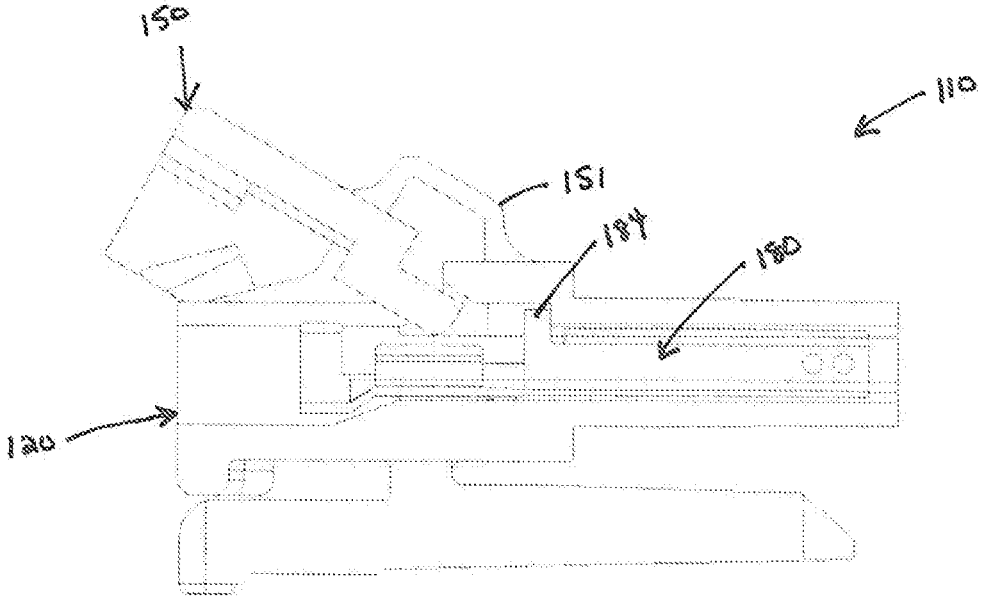
Figure 15:
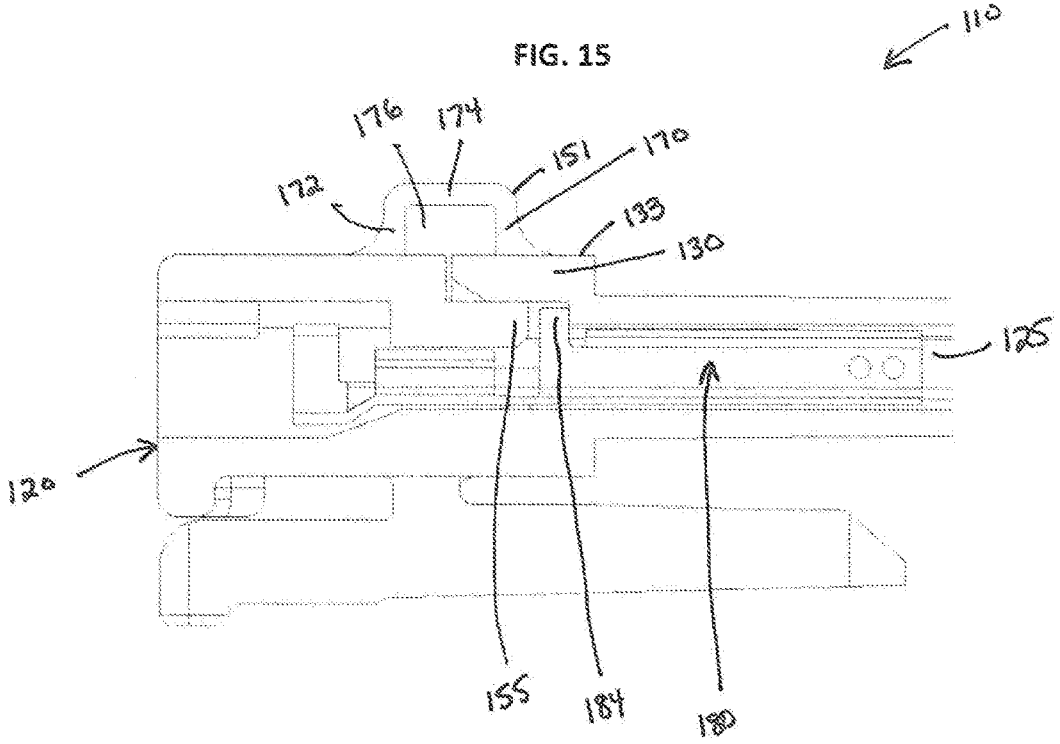

The unique motion of the top portion 160 of the hinge 151 rotating first followed by the rotation of the bottom portion 162 allows the L-shaped feature (the combination of the pushing flanges 155 and the portion of the main wall 159 which defines the rear edge 153) of the TPA member 150 to enter the channel 125 of the housing 120 while not interfering with any terminal 180 or respective wire (not shown) that is positioned within the channel 125, as best illustrated in FIGS. 14 and 15.

FIG. 15 shows the TPA member 150 rotated a full (approximate) one-hundred eighty (180) degrees and fully seated. The L-shaped feature of the TPA member 150 is thus in its final position directly behind the projections 184 of the terminal 180, thus preventing the terminal 180 from being pulled or pushed out of the housing 120. As the L-shaped feature of the TPA member 150 is inside the housing 120, the L-shaped feature prevents the TPA member 150 from moving upwardly (when viewed as in FIG. 15) which keeps the TPA member from coming loose in the event that the hinge 151 cracks and breaks loose.

As illustrated in FIG. 15, the hinge 151 also takes on a unique, low-profile configuration. When the TPA member 150 is fully seated, the hinge 151 has a forward, generally vertical portion 170, a rearward, generally vertical portion 172, and a middle, generally horizontal portion 174. The middle portion 174 is generally planar and is generally parallel to the top surface 133 (which is also generally planar) of the base 130, such that a gap 176 is provided between the hinge 151, the top surface 133 of the base 130, and the TPA member 150, where the gap 176 is generally rectangular in cross-section or in configuration when viewed from the side, as in FIG. 15. This configuration of the hinge 151 results in a unique, low-profile configuration of the hinge 51 as compared to other known hinged TPA members, including the hinge 51 of the first embodiment which, when the TPA member 50 is fully seated, creates a rounded or U-shaped hinge with a resultant rounded or U-shaped gap. In each case where the hinge 151 would have the same height as the hinge 51, the connector 110 using the hinge 151 would provide for a valuable low-profile configuration as compared to the connector 10 using the hinge 51.

Thus, because of the provision of the cutout portion 166, the TPA member 150 rotates approximately one-hundred eighty (180) degrees, but the top portion 160 of the hinge 151 is designed to rotate approximately ninety (90) degrees first, followed by an approximately ninety (90) degree rotation of the bottom portion 162 in one sequential motion. As such, the hinge 151, in essence, only rotates approximately ninety (90) degrees, but such rotation, in essence, yields one-hundred eighty (180) degrees of motion for the TPA member 150, which allows the L-shaped feature of the TPA member 150 to hook into position inside the housing 120.

Figure 16:
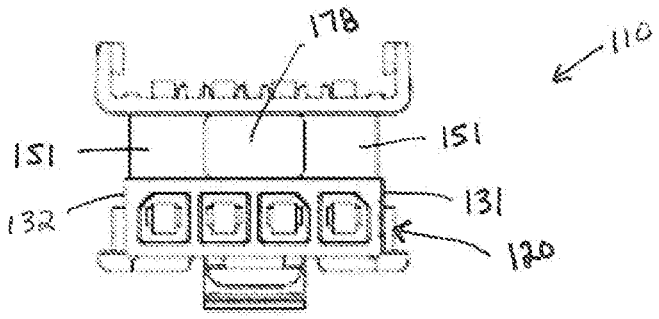
Figure 17:
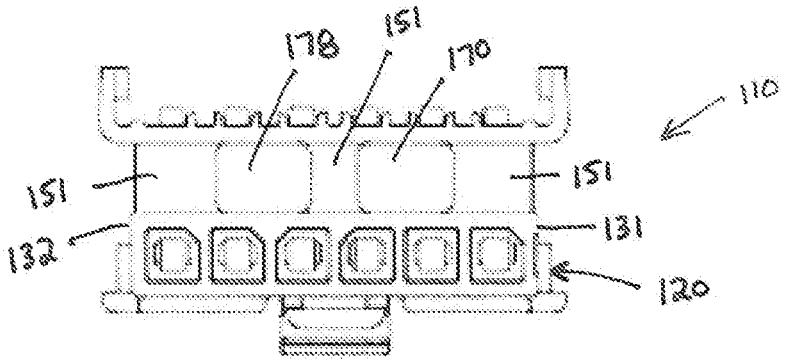

It is to be understood that the hinge 151 of the connector 110 could be comprised of a single hinge, including one which substantially extends from the first side 131 of the housing 120 to the second side 132 of the housing 120, as generally illustrated in FIGS. 11-15, or could be comprised of a plurality of hinges 151, where adjacent hinges 151 are separated from one another by a gap 178, as generally illustrated in FIGS. 16 and 17. When the connector 110 includes two hinges 151, in order to provide proper stability, one of the hinges 151 is preferably provided proximate to the first side 131 of the housing 120 and the other one of the hinges 151 is preferably provided proximate to the second side 132 of the housing 120, as illustrated in FIG. 16. When the connector 110 includes three hinges 151, in order to provide proper stability, one of the hinges 151 is preferably provided proximate to the first side 131 of the housing 120, another one of the hinges 151 is preferably provided proximate to the second side 132 of the housing 120, and the last hinge 151 is preferably provided generally equidistant between the first and second sides 131, 132 of the housing 120.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A connector, the connector comprising:

a housing with a base, the base including a first side and a second side and having a top surface that extends between the first and second side, the base including a channel; and a terminal position assurance (TPA) member which is operatively associated with the housing, the TPA member having at least one hinge which extends from the top surface of the base, the at least one hinge having top and bottom portions, the bottom portion being provided proximate to the base, the top portion having a portion thereof cutout to provide a weakened portion of the at least one hinge, the TPA member including a rearwardly extending L-shaped feature, wherein upon a force being applied to the TPA member which causes the TPA member to move in a rearward direction, the at least one hinge is configured to first rotate about the weakened portion and, thereafter, is configured to rotate about the bottom portion, thereby allowing the L-shaped feature to be inserted into the channel.

2. The connector as defined in claim 1, wherein the at least one hinge is configured to rotate approximately ninety (90) degrees about the weakened portion, the at least one hinge is configured to rotate approximately ninety (90) degrees about the bottom portion, and the L-shaped feature is configured to rotate approximately one-hundred eighty (180) degrees.

3. The connector as defined in claim 1, wherein the at least one hinge substantially extends from the first side to the second side of the base.

4. The connector as defined in claim 3, wherein the TPA member has only one hinge.

5. The connector as defined in claim 1, wherein the at least one hinge comprises a plurality of hinges, with adjacent hinges being separated from one another by a gap.

6. The connector as defined in claim 5, wherein first and second hinges are provided, the first hinge being positioned proximate to the first side of the base, the second hinge being positioned proximate to the second side of the base.

7. The connector as defined in claim 5, wherein first, second and third hinges are provided, the first hinge being positioned proximate to the first side of the base, the second hinge being positioned proximate to the second side of the base, and the third hinge is positioned generally equidistantly between the first and second sides of the base.

8. The connector as defined in claim 1, wherein the cutout portion of the at least one hinge is provided on a rear side of the at least one hinge.

9. The connector as defined in claim 1, wherein the cutout portion of the at least one hinge is crescent-shaped.

10. The connector as defined in claim 1, wherein the L-shaped feature includes a rear edge of the TPA member and a pushing flange that extends past the rear edge in the rearward direction.

11. The connector as defined in claim 10, wherein the at least one hinge extends a first distance from the top surface to the base, and wherein the pushing flange extends past the rear edge in the rearward direction a second distance, and wherein the first distance is greater than the second distance.

12. The connector as defined in claim 1, wherein the first side of the base includes an angled retention flange with a sloped surface, and wherein the TPA member includes a locking tab with an angled surface, wherein when the TPA member is moved to be secured to the housing and at least partially positioned within the channel, the locking tab engages the angled retention flange and the sloped surface and the angled surface aid in allowing the TPA member to move into the desired secured position.

13. The connector as defined in claim 1, wherein each of the first and second sides of the base include an angled retention flange with a sloped surface, and wherein the TPA member includes a pair of locking tabs with angled surfaces, wherein when the TPA member is moved to be secured to the housing and at least partially positioned within the channel, each locking tab engages a respective one of the angled retention flanges and the sloped surfaces and the angled surfaces aid in allowing the TPA member to move into the desired secured position.

14. The connector as defined in claim 1, wherein the base includes a pair of channels which are separated from one another by a wall, and wherein the TPA member includes a pair of fingers, wherein when the TPA member is moved to be secured to the housing, the pair of fingers engage the wall.

15. The connector as defined in claim 14, wherein the pair of fingers is curved.

16. The connector as defined in claim 14, wherein the wall has an enlarged end.

17. The connector as defined in claim 16, wherein the pair of fingers snap over the enlarged end of the wall.

18. The connector as defined in claim 14, wherein the L-shaped feature of the TPA member includes first and second pushing flanges which are positioned rearward of the pair of fingers, the pair of fingers being offset from the first and second pushing flanges such that the first pushing flange is positioned on one side of the pair of fingers and such that the second pushing flange is positioned on an opposite side of the pair of fingers.

19. The connector as defined in claim 14, wherein the wall is positioned generally equidistantly between the first and second sides.

20. The connector as defined in claim 1, wherein the base includes a plurality of channels, wherein adjacent channels are separated from one another by a wall, the base including a forward top surface that extends between the first and second sides which covers a forward portion of each channel such that a rearward portion of each channel is open both upwardly and rearwardly, and wherein when the TPA member is moved to be secured to the housing, the TPA member covers the rearward portion of each channel such that each channel is only open rearwardly.

21. A connector, the connector comprising:

a housing with a base, the base having a generally planar top surface, the base including a channel; and a terminal position assurance (TPA) member which is configured to be secured within the channel of the base, the TPA member having at least one hinge which extends from the top surface of the base, wherein when the TPA member is secured within the channel of the base, the at least one hinge has a middle portion which is generally planar and which is generally parallel to the top surface of the base of the housing.

22. The connector as defined in claim 10, wherein the pushing flange is configured to be inserted into the channel and to extend to a position below the top surface of the base of the housing.

23. A connector, the connector comprising:

a housing with a base, the base including a first side and a second side and having a top surface that extends between the first and second side, the base including a channel; and a terminal position assurance (TPA) member which is operatively associated with the housing, the TPA member having at least one hinge which extends from the top surface of the base, the at least one hinge having top and bottom portions, the bottom portion being provided proximate to the base, the top portion having a portion thereof cutout to provide a weakened portion of the at least one hinge, the TPA member including a rearwardly extending L-shaped feature, wherein upon a force being applied to the TPA member, the at least one hinge is configured to first rotate about the weakened portion and, thereafter, is configured to rotate about the bottom portion, thereby allowing the L-shaped feature to be inserted into the channel, and wherein the first side of the base includes an angled retention flange with a sloped surface, and wherein the TPA member includes a locking tab with an angled surface, wherein when the TPA member is moved to be secured to the housing and at least partially positioned within the channel, the locking tab engages the angled retention flange and the sloped surface and the angled surface aid in allowing the TPA member to move into the desired secured position.

24. A connector, the connector comprising:

a housing with a base, the base including a first side and a second side and having a top surface that extends between the first and second side, the base including a channel; and a terminal position assurance (TPA) member which is operatively associated with the housing, the TPA member having at least one hinge which extends from the top surface of the base, the at least one hinge having top and bottom portions, the bottom portion being provided proximate to the base, the top portion having a portion thereof cutout to provide a weakened portion of the at least one hinge, the TPA member including a rearwardly extending L-shaped feature, wherein upon a force being applied to the TPA member, the at least one hinge is configured to first rotate about the weakened portion and, thereafter, is configured to rotate about the bottom portion, thereby allowing the L-shaped feature to be inserted into the channel, and wherein each of the first and second sides of the base include an angled retention flange with a sloped surface, and wherein the TPA member includes a pair of locking tabs with angled surfaces, wherein when the TPA member is moved to be secured to the housing and at least partially positioned within the channel, each locking tab engages a respective one of the angled retention flanges and the sloped surfaces and the angled surfaces aid in allowing the TPA member to move into the desired secured position.

* * * * *